US005707455A

United States Patent [19]

Tomita

[11] Patent Number: 5,707,455

[45] Date of Patent: Jan. 13, 1998

[54] AUTOMATED CLEANING METHOD OF EXTERIOR WALL OF BUILDING

[76] Inventor: Katsuaki Tomita, 76, Shimoyakiri, Matsudo-shi, Chiba-ken 271, Japan

[21] Appl. No.: 548,463

[22] Filed: Oct. 26, 1995

[30] Foreign Application Priority Data

Oct. 27, 1994 [JP] Japan ..... 6-286170

[51] Int. Cl.[6] ..... B08B 1/00; B08B 7/04; A47L 1/02

[52] U.S. Cl. ..... 134/18; 134/42; 15/50.1; 15/103

[58] Field of Search ..... 134/18, 42, 32, 134/34; 15/50.1, 103

[56] References Cited

U.S. PATENT DOCUMENTS

| | | | |
|---|---|---|---|
| 3,646,630 | 3/1972 | Russell | 15/50.1 X |
| 4,809,384 | 3/1989 | Yokota et al. | 15/103 |

FOREIGN PATENT DOCUMENTS

| | | | |
|---|---|---|---|
| 2 605 872 | 5/1988 | France . | |
| 2636831 | 9/1988 | France . | |
| 2 636 831 | 3/1990 | France . | |
| 1 628 595 | 8/1970 | Germany . | |
| 2748142 | 10/1977 | Germany | 15/103 |
| 38 38 299 | 5/1990 | Germany . | |
| 40 16 259 | 10/1990 | Germany . | |
| 5293062 | 11/1993 | Japan | 15/103 |
| 6007267 | 1/1994 | Japan | 15/103 |
| 2145927 | 4/1985 | United Kingdom | 15/103 |
| 93/24044 | 12/1993 | WIPO | 15/103 |

*Primary Examiner*—Robert J. Warden
*Assistant Examiner*—Saeed Chaudhry
*Attorney, Agent, or Firm*—Evenson, McKeown, Edwards & Lenahan, P.L.L.C.

[57] ABSTRACT

An automated cleaning method is provided for an exterior wall of a building. Elongated, water-tight or electrically-insulating hollow members are accommodated within upper and lower sash rails constructing said exterior wall so that said hollow members continuously extend in horizontal directions, respectively. An electrical conductor extends in one of the hollow members. The other hollow member forms a drainage. A cleaning apparatus main unit is arranged so that said cleaning apparatus main unit is supplied with electric power through said conductor to permit self-travelling in a horizontal direction along said exterior wall and is also supplied with washing water from said drainage to permit cleaning of a surface of said exterior wall. The washing water is drained into said drainage subsequent to the cleaning by said cleaning apparatus main unit. The washing water can be recirculated for reuse.

16 Claims, 17 Drawing Sheets

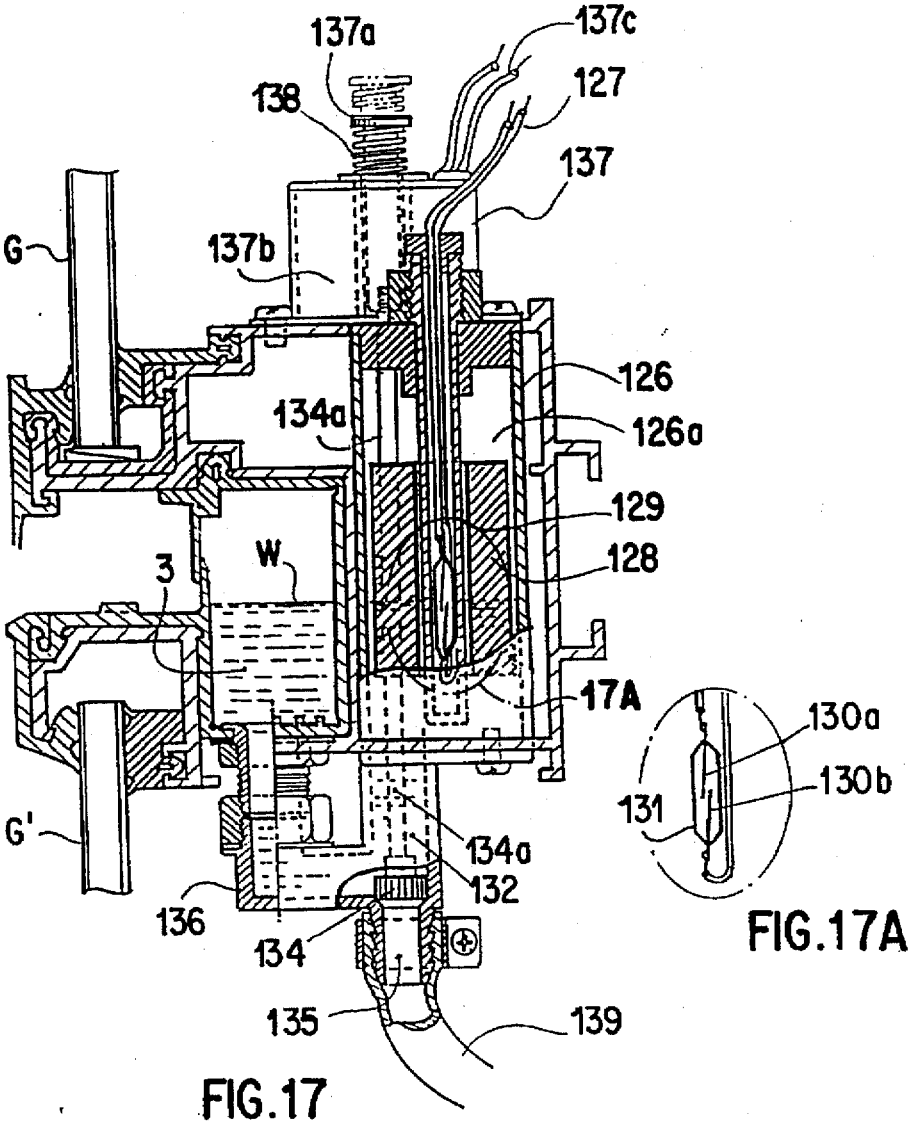
FIG.17A
FIG.17
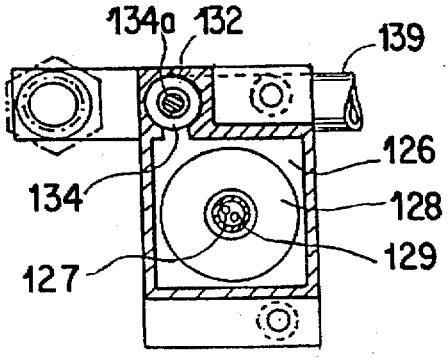
FIG.18

AUTOMATED CLEANING METHOD OF EXTERIOR WALL OF BUILDING

BACKGROUND OF THE INVENTION a) Field of the Invention

This invention relates to a method for automatically cleaning not only windowpanes but also a wall itself in an exterior wall of a building while making use of frames which hold the windowpanes in place, and also to apparatuses therefor.

b) Description of the Related Art

Upon cleaning windowpanes in an exterior wall of a building, it has heretofore been the practice, except for the case of openable windows which permit direct cleaning from the interior, to clean them by man power from the exterior by cleaning crew in a gondola suspended by a crane from the top of building. In the case of a high-rise building or a building with a wide area to be cleaned, a crane is mounted on a guide rail arranged along an outer wall of the building. In a position suspended from the crane, a cleaning machine internally equipped with a washing water tank, a rotary cleaning brush and the like is mounted on one or two of guide rails formed or otherwise arranged on mullions of the building. The crane is then operated by an operator to move the cleaning machine up and down along the one or two guide rails, whereby windowpanes and the like are cleaned. The crane is then moved to mount the cleaning machine on the adjacent one or two guide rails and the above-described work is repeated.

However, in the case that out of the conventional methods described above, the cleaning crew step onto the gondola suspended from the top of the building and perform cleaning by man power from the exterior as is practiced usually, there is always the potential danger that the gondola and the like suspended from the crane may accidentally fall due to wind or the like. In addition, due to the trend of the building design especially in recent years, the surface of an exterior wall of a building is often formed as a smooth surface. This means that in the vertical direction of a building, no guide rails are found for a gondola suspended by a crane from the top of a building. As a consequence, the gondola tends to be blown by wind and hence to be swung. As a matter of fact, the percentage of occurrence of falling accidents of gondolas themselves is increasing.

Further, cleaning of windowpanes and an exterior wall of a building by cleaning crew from the exterior of the building is accompanied by the drawback that the privacy inside the building may be intruded through the windowpanes. The cleaning itself by the cleaning crew is periodical so that even if a particular building urgently requires cleaning, nothing can be done other than simply awaiting the next regular cleaning. In the case of the cleaning performed by the man power of the cleaning crew, the cleaning crew have to pay considerable attention to balancing on the gondola so that they cannot apply sufficient power. It is therefore difficult to clean tiles on the exterior wall of the building, especially, joints and the like between such tiles, leading to the potential problem that they tend to be left uncleaned.

On the other hand, when cleaning is performed by the cleaning machine which can be moved up and down by operating the crane on the top of the building, a substantial initial cost is required for the cleaning machine, which is internally equipped with the cleaning tank, rotary cleaning brush and like, and others in addition to the mullions or guide rails arranged on the exterior wall of the building.

Further, the cleaning machine itself becomes large in volume and weight because of the incorporation of equipments such as the washing water tank and the cleaning rotary brush. Operation of the cleaning machine requires a skilled professional operator, resulting in a substantial increase in the running cost spent for the cleaning work alone. This method therefore involves the drawback that it will hardly become popular to the public.

SUMMARY OF THE INVENTION

An object of the present invention is therefore to improve the above-described drawbacks of the conventional art and to make it possible to easily surely clean not only windowpanes of a building but also tiles forming its exterior wall, for example, even joints between such tiles while sufficiently ensuring the safety of workers.

In one aspect of the present invention, there is thus provided an automated cleaning method for an exterior wall of a building. Elongated, water-tight or electrically-insulating hollow members are accommodated within upper and lower sash rails constructing said exterior wall so that said hollow members continuously extend in horizontal directions, respectively. An electrical conductor extends in one of the hollow members. The other hollow member forms a drainage. A cleaning apparatus main unit is arranged so that said cleaning apparatus main unit is supplied with electric power through said conductor to permit self-travelling in a horizontal direction along said exterior wall and is also supplied with washing water from said drainage to permit cleaning of a surface of said exterior wall. The washing water is drained into said drainage subsequent to the cleaning by said cleaning apparatus main unit.

In another aspect of the present invention, there is also provided an automated cleaning method for an exterior wall of a building. Elongated, water-tight or electrically-insulating hollow members are accommodated within vertical sash rails or mullions constructing said exterior wall so that said hollow members continuously extend in vertical directions, respectively. An electrical conductor extends in one of the hollow members. The other hollow member forms a drainage. A cleaning apparatus main unit is arranged so that said cleaning apparatus main unit is supplied with electric power through said conductor to permit self-travelling in a vertical direction along said exterior wall and is also supplied with washing water from said drainage to permit cleaning of a surface of said exterior wall. The washing water is drained into said drainage subsequent to the cleaning by said cleaning apparatus main unit.

In a further aspect of the present invention, there is also provided a cleaning apparatus main unit comprising a mobile body capable of self-travelling along a surface of a wall of a building, a motor for driving said mobile body, a pump for drawing washing water from a drainage and then spraying the same against said surface of said wall through spray nozzles, and a drainage for draining the washing water towards said drainage subsequent to the cleaning. The mobile body, motor and pump are accommodated within said main unit. Preferably, the cleaning apparatus main unit may further comprise a brush and wiper arranged for sliding contact with said surface of said wall, holders for supporting said brush and wiper, respectively, and means for normally maintaining said brush and wiper in contact at free ends thereof with said surface of said wall.

In a still further aspect of the present invention, there is also provided a building exterior wall comprising sash upper and lower sash rails or comprising vertical sash rails and/or mullions, guide paths arranged on said sash upper and lower sash rails or said vertical sash rails and/or mullions, respectively, for allowing a cleaning apparatus main unit to travel under guidance along a surface of a wall of a building, electrically-insulating or water-tight hollow member accommodated within said sash upper and lower sash rails or said vertical sash rails and/or mullions respectively, an electrical conductor extending in one of said hollow members, and a drainage formed in the other hollow member.

Owing to the features described above, upon cleaning windowpanes and the like which form an exterior wall of a building, cleaning crew inside of the building cause the cleaning apparatus main unit—which is mounted for self-travelling on each set of upper and lower sash rails or a set of vertical rails and/or mullions arranged in horizontal or vertical direction on the exterior wall of the building and is internally equipped with a wiper, a brush and the like—by remote operation and cause the wiper, the brush and the like to move vertically or horizontally while spraying against the corresponding windowpanes and the like, washing water supplied either directly or through a water supply hose from a drainage arranged in one of the upper and lower sash rails or the vertical rails and/or mullions. By using cleaning apparatus main bodies of the above-described type as many as needed, the cleaning crew can therefore surely clean with ease at low cost the exterior wall of the building without moving out of the building. It is desired that while cleaning is not performed, each cleaning apparatus main unit can be maintained at a predetermined location on the exterior wall of the building. For this purpose, each cleaning apparatus main unit can preferably be provided with such an external design that it can serve as a decorative frame. As a desired alternative, each cleaning apparatus main unit can be received in a storage pocket arranged on the exterior wall and defining an elongated slit through which the cleaning apparatus ratus main unit can enter the storage pocket. Preferably, the cleaning apparatus main unit is held in substantially the same plane as the exterior wall. It is also preferred to permit maintenance and inspection of each cleaning apparatus main body from the interior of the building.

The present invention has therefore brought about numerous advantages. It is possible to promptly surely perform cleaning work of windowpanes and the like of an exterior wall of a building while sufficiently protecting the privacy of the interior of the building and, at the same time, ensuring the safety of cleaning crew.

BRIEF DESCRIPTION OF THE DRAWINGS

FIG. 17 is a fragmentary vertical view showing a drain structure for the horizontal drainage;

FIG. 18 is a top plan view of a float switch and its peripheral members illustrated in FIG. 17;

DETAILED DESCRIPTION OF THE INVENTION AND PREFERRED EMBODIMENTS

Figure 7:
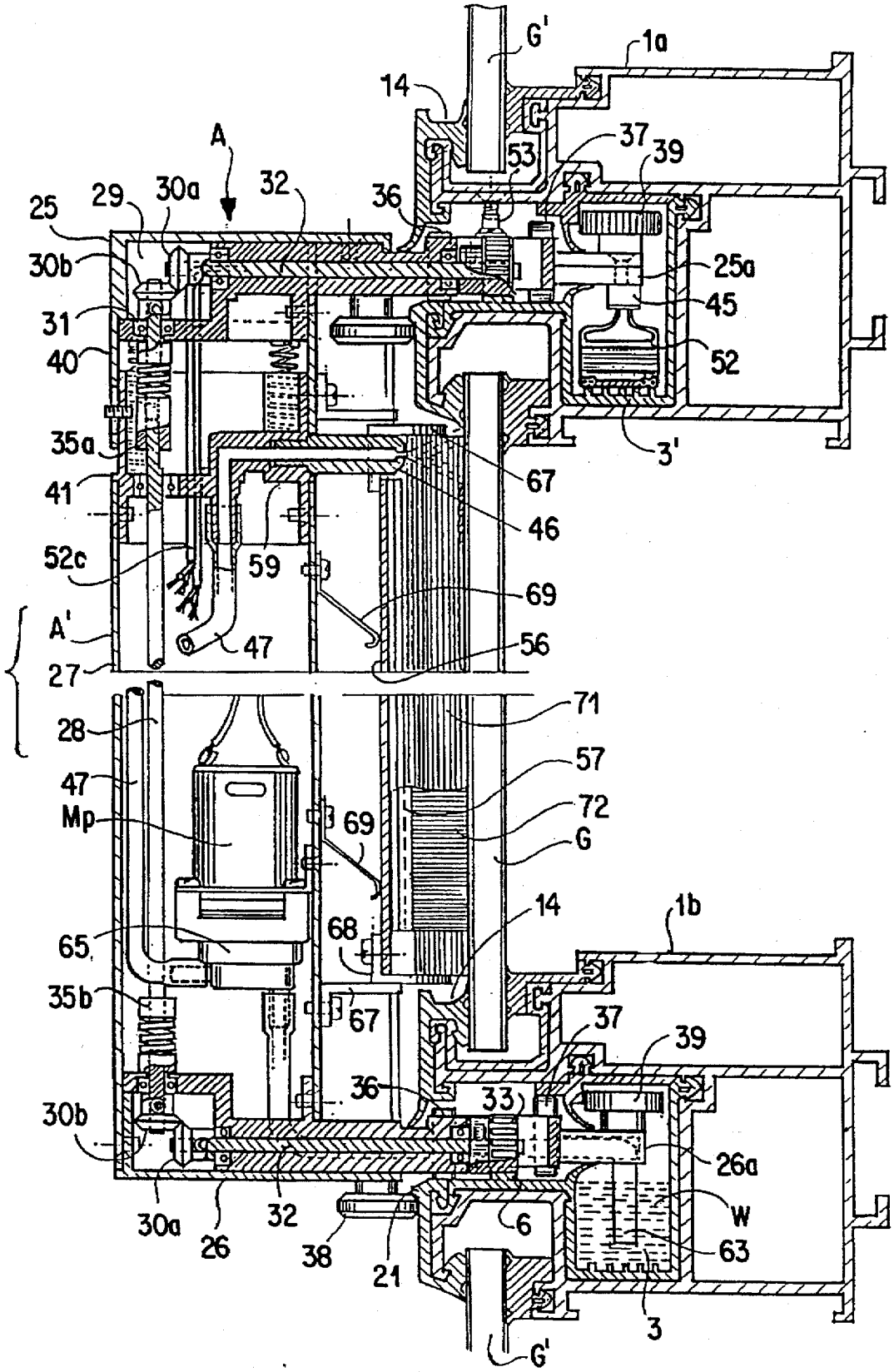
FIG. 7 is a vertical side cross-sectional view of the horizontal-rail-mounting cleaning apparatus main unit and the upper and lower rails associated therewith, said cleaning apparatus main unit and said upper and lower rails both pertaining to the first embodiment of the present invention.

The first embodiment of the present invention will hereinafter be described with reference to FIGS. 5, 7–9, 11, 12 and 16–18. Referring first to FIG. 7, designated at letter A is the automated cleaning apparatus of the horizontal-rail-mounting type for an exterior wall of a building, which pertains to the first embodiment of the present invention. The automated cleaning apparatus A comprises a sash frame 1*a*, 1*b* defining a closed space in which a windowpane G is held at upper and lower edge portions thereof, in other words, an upper rail 1*a* and a lower rail 1*b*, and a cleaning apparatus main unit A' mounted on the sash frame, that is, the upper rail 1*a* and the lower rail 1*b* so that the cleaning apparatus main unit A' can travel by itself in a horizontal direction.

Figure 11:
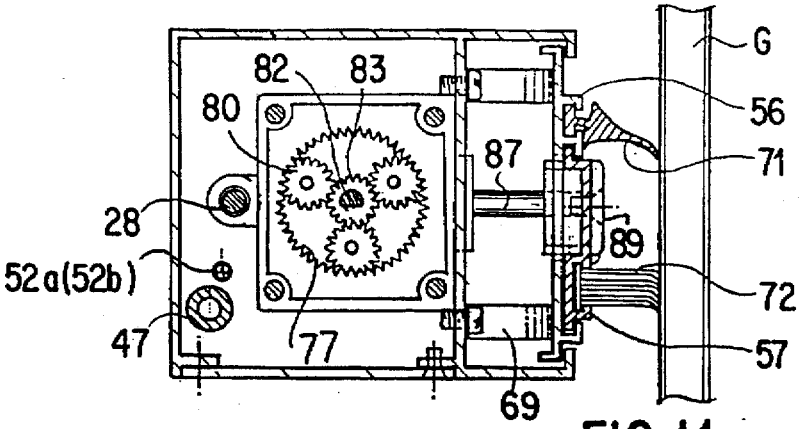
FIG. 11 is a horizontal cross-sectional view of a self-travelling unit in the horizontal-rail-mounting cleaning apparatus main unit.
Figure 12:
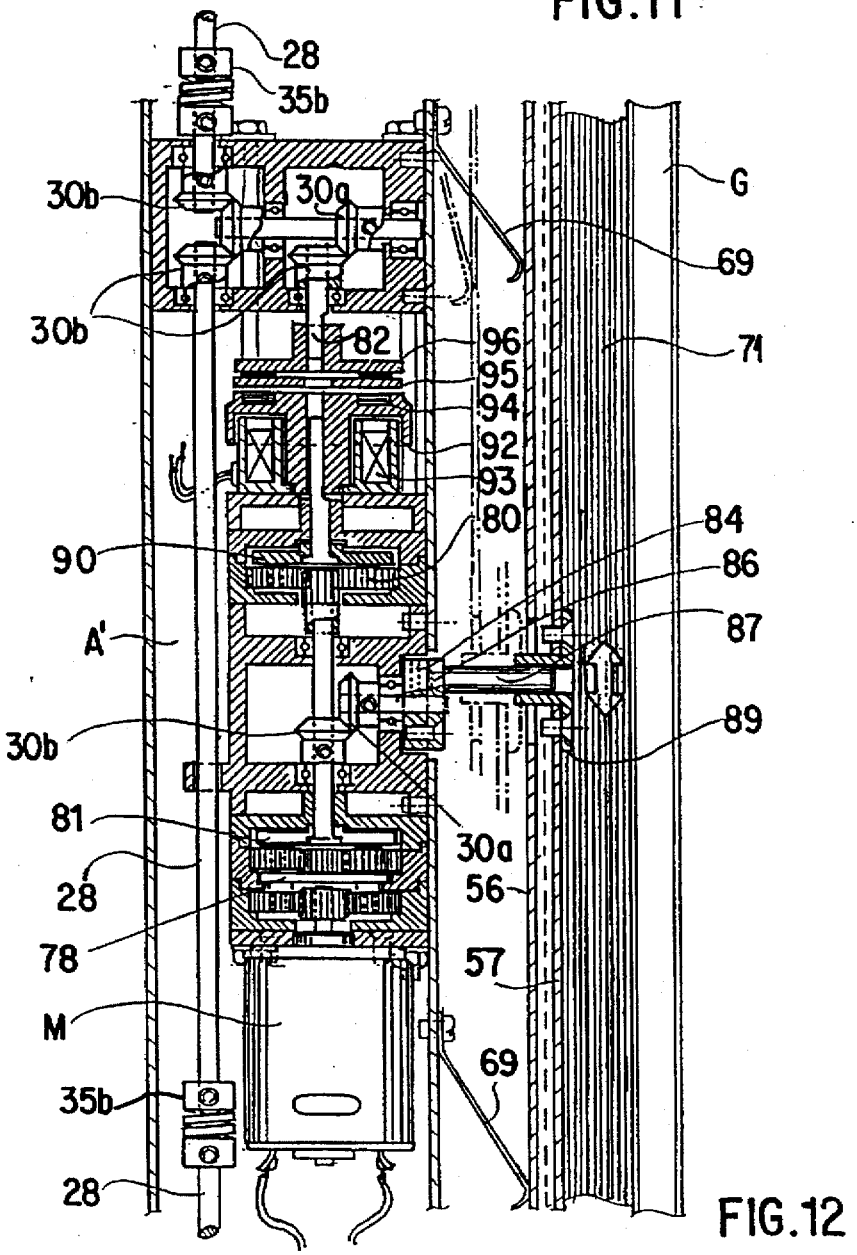
FIG. 12 is a vertical cross-sectional view of a central portion of the self-travelling unit in the horizontal-rail-mounting cleaning apparatus main unit.

Cleaning of the windowpane G by the automated cleaning apparatus A is performed as will be described hereinafter. The frame is composed of the upper and lower rails 1*a*,1*b*, which are arranged in an up-and-down parallel relationship on the exterior wall of the building to fixedly hold the windowpane G. The upper and lower rails 1*a*,1*b* form closed spaces, in which drainages or the like 3 are arranged, respectively. Each drainage 3 is in communication with the outside through an open edge C (FIG. 5) which can be hermetically closed by a water-tight or electrically-insulating elastic edge member 15 formed as an integral member with the drainage 3 and made of synthetic rubber or the like. Using the horizontal drainages or the like 3 arranged as hollow members in the upper and lower rails 1*a*,1*b*, the cleaning apparatus main unit A' is mounted so that the cleaning apparatus main unit A' can travel by itself. As is illustrated in FIGS. 11 and 12, the cleaning apparatus main unit A' is internally provided with a gear motor M, a drive shaft 82 rotatable when driven by the gear motor M, a bevel gear 30*b* mounted on the drive shaft 82, a brush holder 57 carrying a brush 72, a turning shaft 87 with the brush holder 57 held at a free front end thereof and also with a pulley 86 held at a rear end thereof, a rotary disk 84 coupled with the pulley 86, and a bevel gear 30*a* mounted on the rotary disk 84 and maintained in meshing engagement with the bevel gear 30*b*. A cleaning device, which is composed of a wiper 71, a vertically-movable brush 72 and the like, is normally maintained in contact with the windowpane G. Referring back to FIG. 7, also arranged inside the cleaning apparatus main unit A' include a gear motor Mp, which is driven by electric power fed through lead wires 52 inserted as a conductor through the horizontal hollow member 3' in the upper rail 1*a*, and a water supply pump 65 driven by the gear motor Mp. When the gear motors M,Mp are driven, the cleaning device is caused to move relative to the windowpane G while spraying washing water W, which has been introduced from the outside into the horizontal drainage 3 arranged in the lower rail 1*b*, through a water intake pipe 63, which extends into the lower rail 1*b*, and also through a water supply pipe 47. At the same time, the washing is recovered in the horizontal drainage 3 through a drainage 14 formed in an upper flange of the lower rail 1*b*, and is reused.

Figure 6:
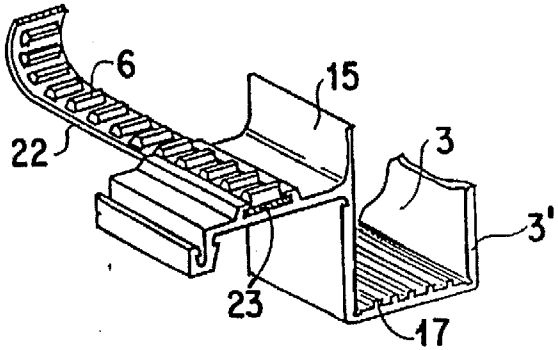
FIG. 6 is a fragmentary perspective view of a hollow member (horizontal drainage) shown in FIG. 5.
Figure 5:
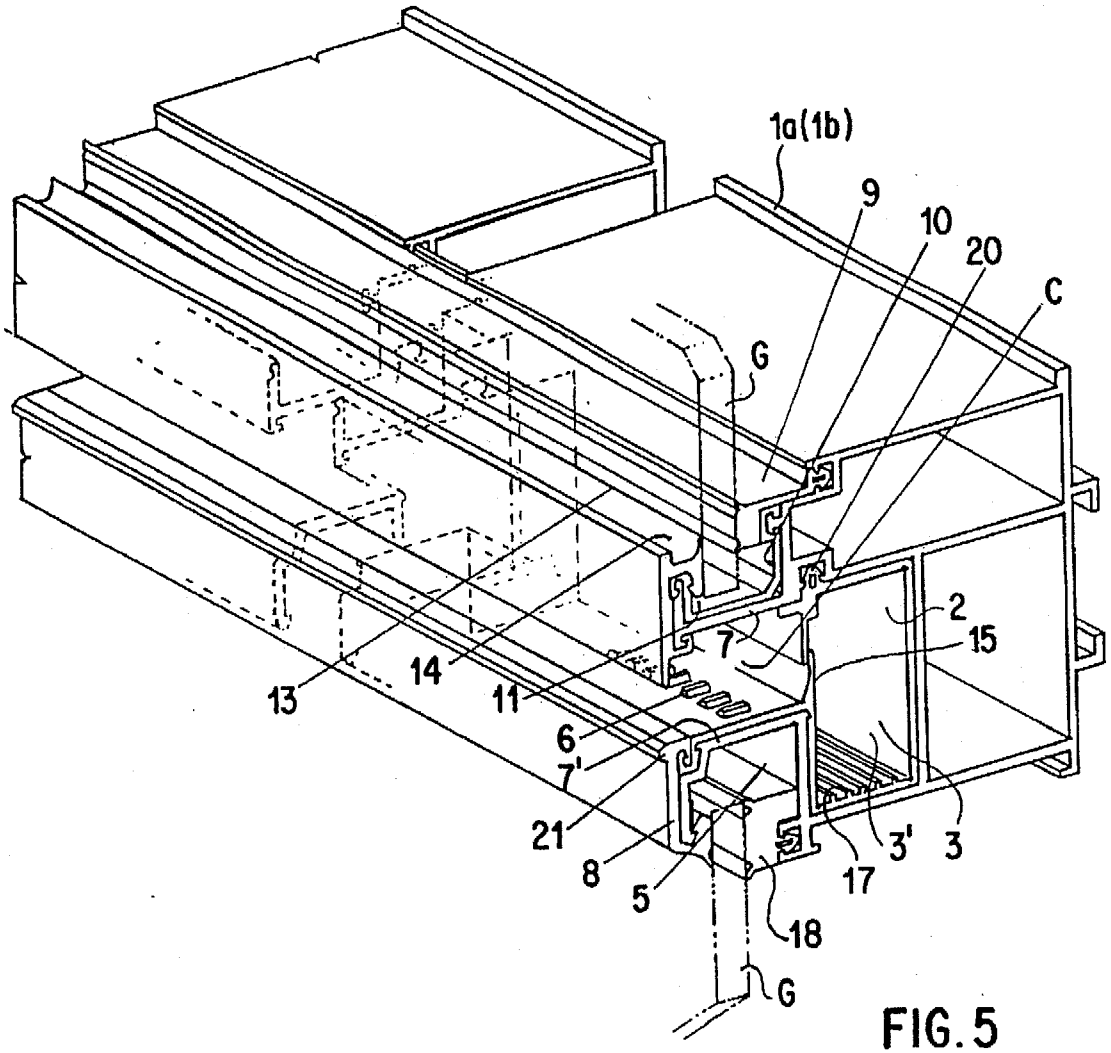
FIG. 5 is a fragmentary perspective view of upper and lower rails according to the first embodiment of the present invention.

Reference is next had to FIGS. 5 and 6o The horizontal drainage 3, which is formed of the hollow member 3 arranged in the lower rail 1*b*, is provided on an inner bottom wall thereof with ridges 17. These ridges 17 prevent precipitates from being drawn into the water intake pipe 63 FIG. 7 together with the washing water W to be recirculated therethrough. Further, horizontal upper and lower flanges 7,7' are also arranged extending forward. In the upper horizontal flange 7, a drainage 14 is formed along a lower end edge of the windowpane G' held in place by an inner gasket 9 within a windowpane-receiving channel 11 integrally arranged with the upper horizontal flange 7. In the lower horizontal flange 7', on the other hand, the windowpane G' is held in place together with an inner gasket 18 within a downwardly-open, windowpane-receiving channel 5 integrally arranged with the lower horizontal flange 7' . In addition, the lower horizontal flange 7' is also provided with a rack gear 6 which is maintained in meshing engagement with a self-traveling unit accommodated in the cleaning apparatus main unit A' (FIG. 7) and composed of an upper self-traveling unit 25 (FIG. 7) and a lower self-traveling unit 26 (FIG. 7).

Figure 8:
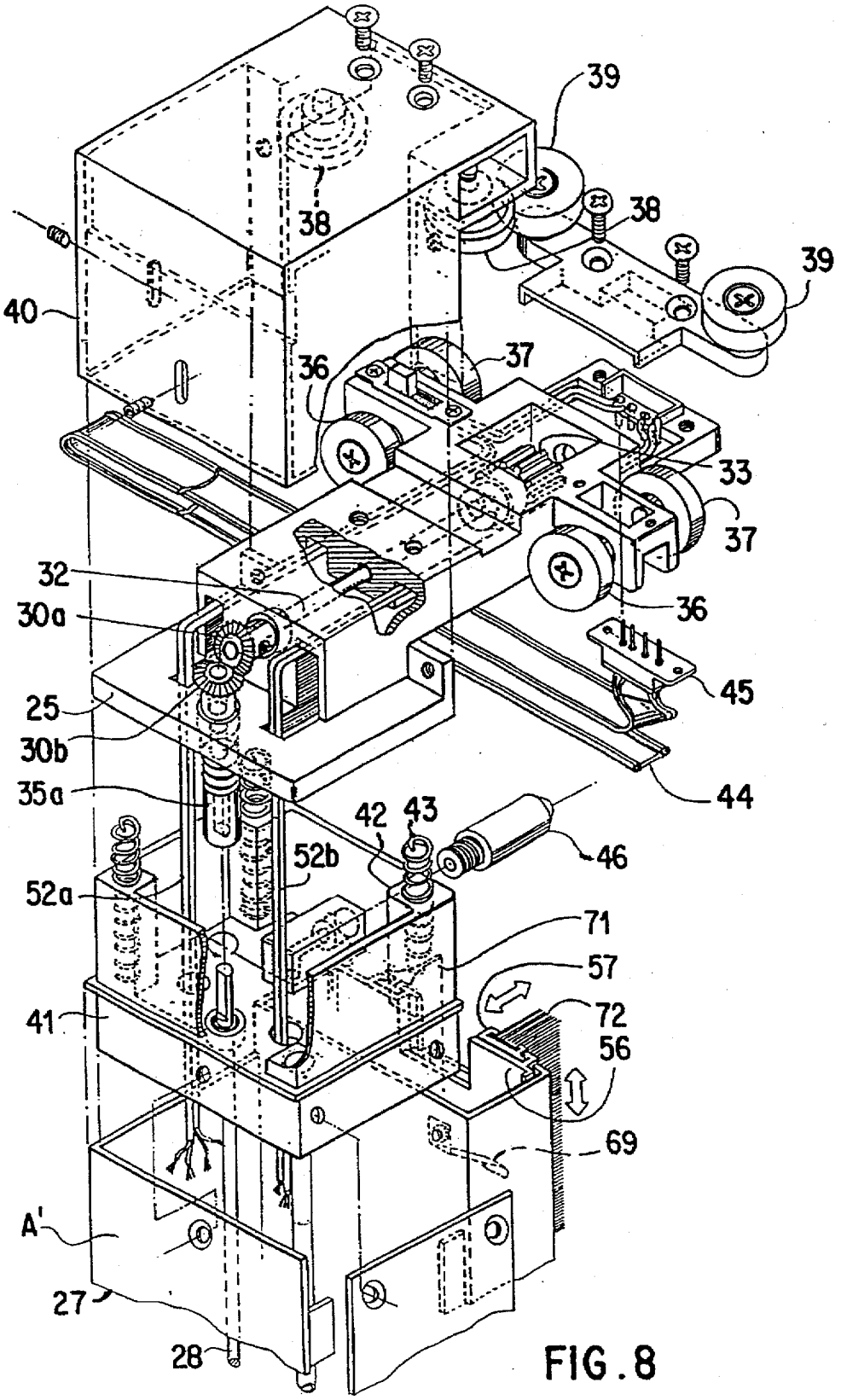
FIG. 8 is a partly-exploded, perspective view of an upper unit of the horizontal-rail-mounting cleaning apparatus main unit, said upper unit being mounted on the upper rail in FIG. 7.
Figure 9:
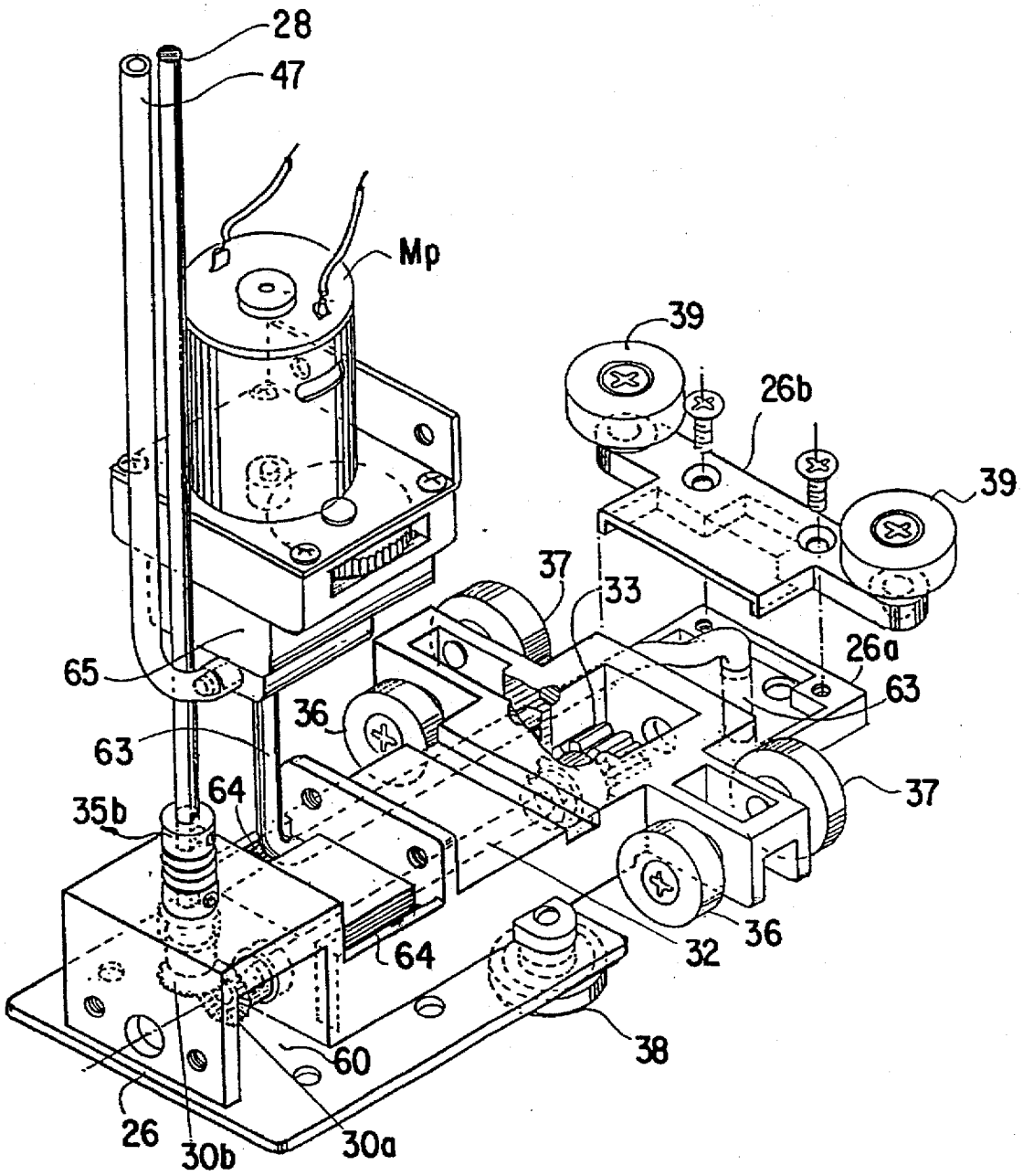
FIG. 9 is a partly-exploded, perspective view of a lower unit of the horizontal-rail-mounting cleaning apparatus main unit, said lower unit being mounted on the lower rail in FIG. 7.

The upper self-traveling unit 25 will next be described with reference to FIG. 8. Rotating power of a drive shaft 28, which is driven via a drive shaft 82 by the gear motor M accommodated in the cleaning apparatus main unit A' (see FIG. 12), is transmitted to a drive shaft 32 of the upper self-travelling unit 25 owing to meshing engagement between a bevel gear 30*a* and a bevel gear 30*b*. The rotating power is therefore transmitted to a pulley gear 33 arranged in mesh with the rack gear 6 disposed on the lower horizontal flange 7' of the upper rail 1*a*. To maintain constant the meshing engagement between the bevel gears 30*a* and 30*b*, a retractable coupling 35*a* is interposed between the drive shaft 28 and the bevel gear (30*b*). Rotation of the pulley gear 33 causes the upper self-traveling unit 25 to travel under the guidance of a jaw 21 of the lower horizontal flange 7' while maintaining guide pulleys 38, which are held on the cleaning apparatus main unit A', in contact with the jaw 21. During this travelling of the upper self-travelling unit 25, wheels 36,37 mounted as an integral unit on the lower horizontal flange 7' of the upper rail 1*a* and guide pulleys 39 disposed inside the hollow member 3' arranged within the upper rail 1*a* are allowed to freely rotate, thereby permitting smooth movement of the upper self-travelling unit 25. Referring next to FIG. 9, the lower self-traveling unit 26 will be described. Rotating power of a drive shaft 28, which is driven via the drive shaft 82 by the gear motor M accommodated in the cleaning apparatus main unit A' (see FIG. 12), is transmitted to a drive shaft 32 of the lower self-travelling unit 26 owing to meshing engagement between a bevel gear 30*a* and a bevel gear 30*b*. The rotating power is therefore transmitted to a pulley gear 33 arranged in mesh with the rack gear 6 disposed on the lower horizontal flange 7' of the lower rail 1*b*. To maintain constant the meshing engagement between the bevel gears 30*a* and 30*b*, a retractable coupling 35*b* is interposed between the drive shaft 28 and the bevel gear (30*b*). Rotation of the pulley gear 33 causes the lower self-traveling unit 26 to travel under the guidance of a jaw 21 of the lower horizontal flange 7' while maintaining guide pulleys 38, which are held on the cleaning apparatus main unit A', in contact with the jaw 21. During this travelling of the lower self-travelling unit 26, wheels 36,37 mounted as an integral unit on the lower horizontal flange 7' of the lower rail 1*a* and guide pulleys 39 disposed inside the hollow member 3' arranged within the lower rail 1*b* are allowed to freely rotate, thereby permitting smooth movement of the lower self-travelling unit 26. By the upper and lower self-traveling unit 25,26 shown in FIG. 8 and FIG. 9, respectively, the cleaning apparatus main unit A' is allowed to travel by itself in both leftwards and rightwards even if the distance between the upper rail 1*a* and the lower rail 1*b* varies a little because such variations can be absorbed by the couplings 35*a*,35*b* connected to the corresponding drive shafts 28.

Figure 10:
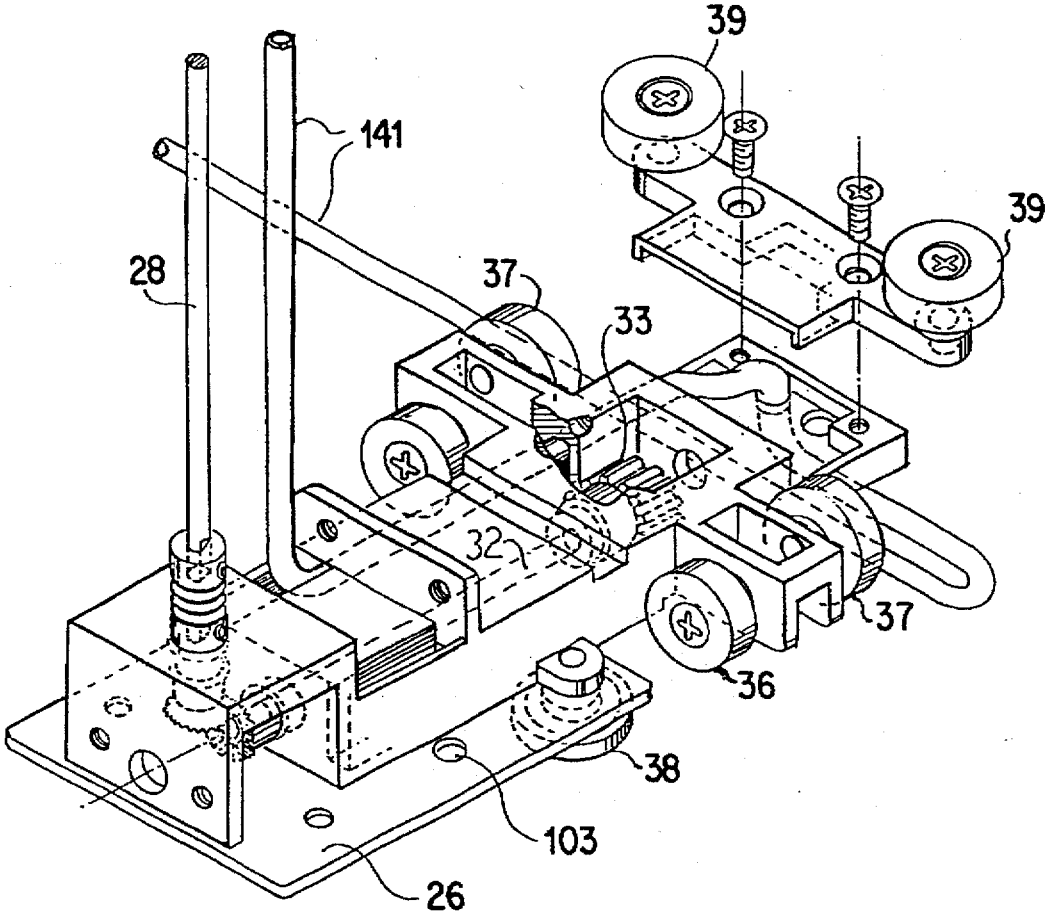
FIG. 10 is similar to FIG. 10, but illustrates a modification of the lower unit.

With reference to FIG. 10, the modification of the above-described lower self-traveling unit 25 will now be described. Like the lower self-traveling unit 25, upon spraying the washing water W against the windowpane G to clean the windowpane G, the washing water W in the horizontal drainage 3 is drawn by the gear pump 65 driven by the gear motor Mp accommodated in the cleaning apparatus main unit A'. Further, inside the horizontal drainage 3 arranged in the lower rail 1b and accommodating therein the guide pulleys 39 of the lower self-traveling unit 26, a water supply hose 141 directly connected to a supply source of washing water is inserted. In accordance with travelling of the cleaning apparatus main unit A', the water supply hose 141 is paid out or taken up so that the washing water W can be smoothly replenished as the washing water is drawn by the gear pump 65.

Since the first embodiment of the present invention is provided with the above-described features, cleaning crew can clean the windowpanes G in the exterior wall of the building by remote-operating the automated cleaning apparatus (A) from the inside or outside of the building as will be described herein-after. First, the automated cleaning apparatus is fed with electric power so that the gear motor M accommodated in the cleaning apparatus main unit A' is actuated. Via the drive shaft 82 and the drive shafts 32,28, driving power of the gear motor M is transmitted to the pulley gears 33 which are arranged in mesh with the rack gears 6 disposed on the lower horizontal flanges 7' extending forward from the upper and lower rails 1a,1b. As a result of the transmission of the driving power from the gear motor M, the self-travelling unit, i.e., the cleaning apparatus main unit A' mounted for self-traveling on the upper rail 1a and lower rail 1b arranged in an up-and-down parallel relationship and forming the frame 1 on the exterior wall of the building, that is, the upper traveling unit 25 and the lower traveling unit 26 are allowed to travel by itself leftwards and rightwards while guiding the guide pulleys 38 by the jaws 25 on the outer surfaces of the corresponding lower horizontal flanges 7' and permitting rotation of the wheels 36,37 in the hollow members 3,3 arranged in the upper and lower rails 1a,1b, respectively. If the operating power supply cord is connected to an electric relay system and an electric timer switch is incorporated, cleaning of a building facing a road on which many pedestrians walk can be performed by unmanned cleaning work in the middle of night, so that troubles associated with splashing and falling of washing water can be avoided.

Upon cleaning, by the gear pump 65 driven by the gear motor Mp accommodated in the cleaning apparatus main unit A', the washing water W is drawn through the water intake pipe 63 which extends into the inside of the cleaning apparatus main unit A' through the open edge of the horizontal drainage 3, said open edge being normally closed by the elastic edge member 15, is compressed, and is then sprayed against the windowpanes G. At the same time, the brush 72 held by the brush holder 57 is moved up and down by the turning shaft 87 carrying thereon the bevel gear 30a which rotates in mesh with the bevel gear 30b mounted on the drive shaft 82 which is in turn connected to the gear motor M. Accordingly, the brush 72 rubs off dirt from the surfaces of the windowpanes G together with the sprayed washing water W and the washing water is wiped off by the wiper 71 held on the wiper holder 56. The used washing water W, which has occurred in this cleaning, flows downwardly along the surface of each windowpane G. By the drainage 14 formed on the windowpane-receiving channel 11 which holds the windowpane G at the lower end edge of the windowpane G along the surface of the windowpane G as an integral unit with the upper horizontal flange 7 of the lower rail 11, the used washing water is recovered again in the horizontal drainage 3 arranged in the lower rail 1b. Precipitates are surely separated out by the ridges 17 in the horizontal drainage 3 so that the used washing water is furnished as the washing water W for reuse.

Figure 2:
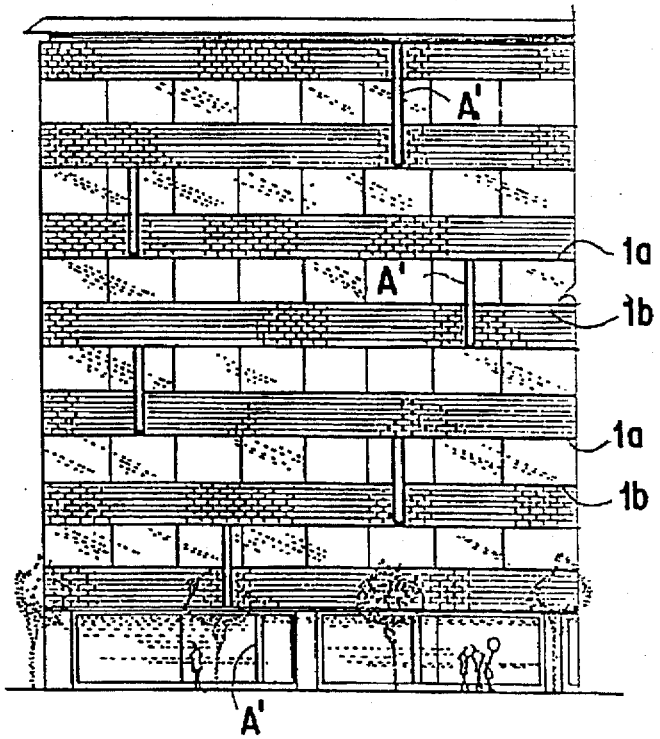
FIG. 2 is similar to FIG. 1, but the horizontal-rail-mounting cleaning apparatus main units have been mounted on an exterior wall different from that of FIG. 1.
Figure 13:
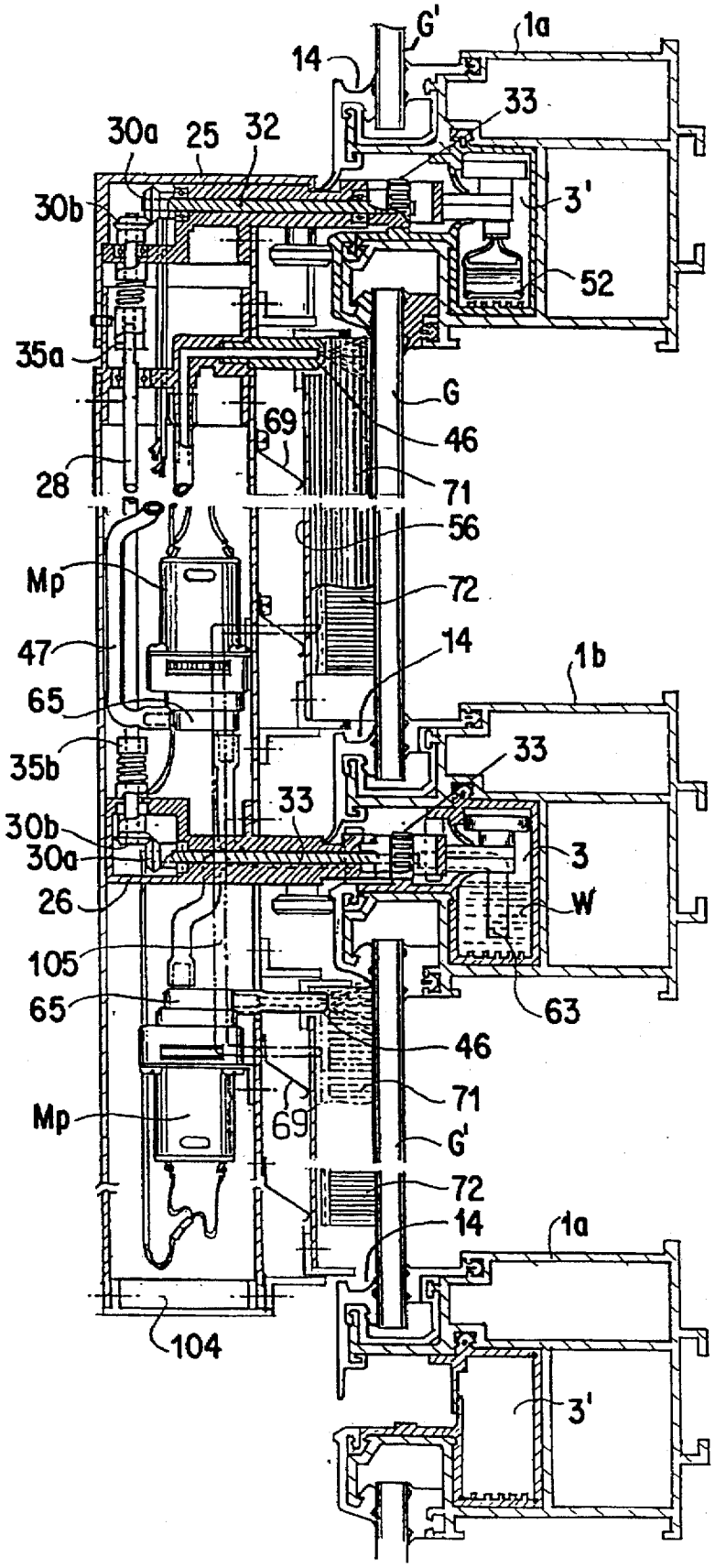
FIG. 13 is similar to FIG. 7, but depicts a modification of the horizontal-rail-mounting cleaning apparatus main unit according to the first embodiment.
Figure 14:
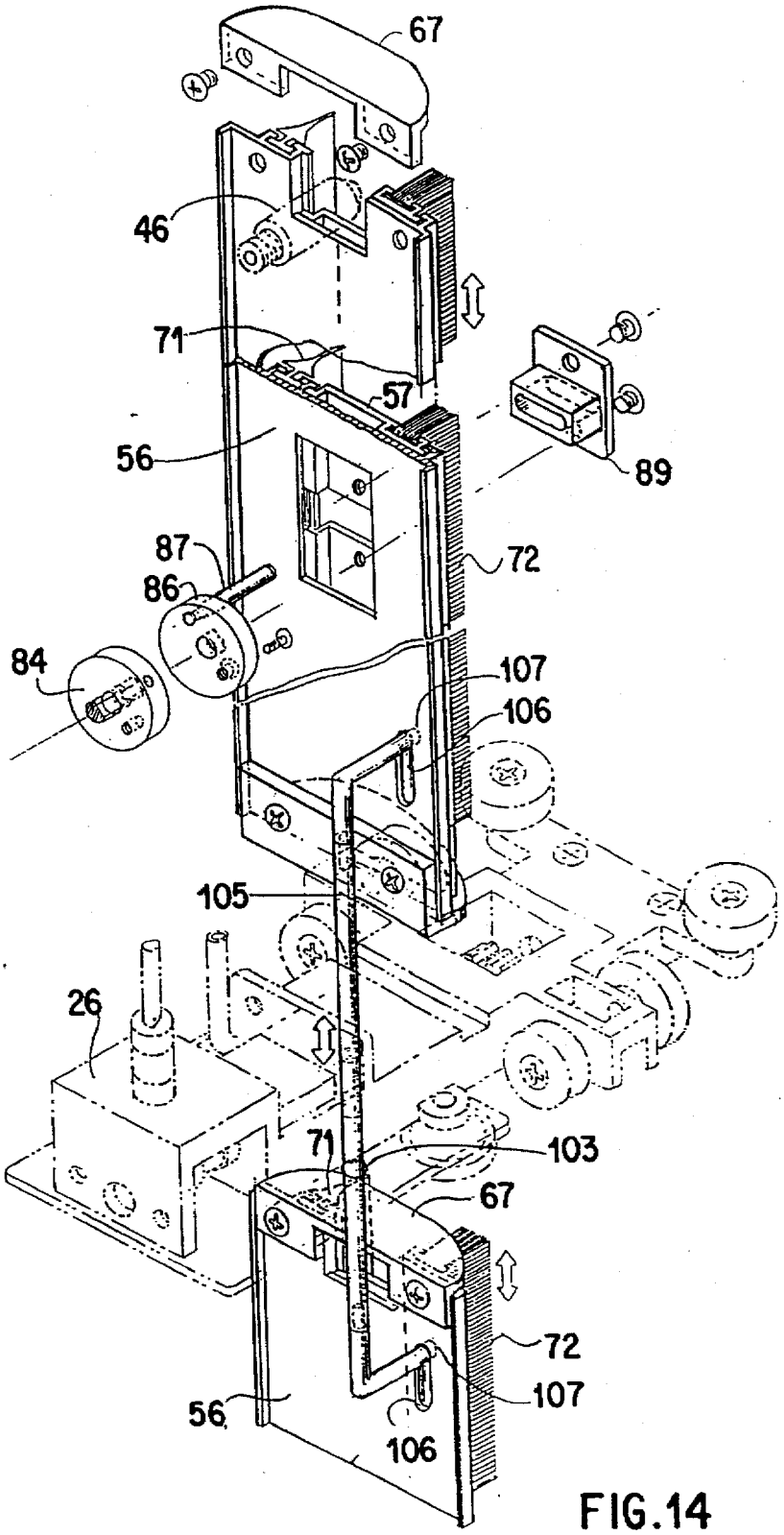
FIG. 14 is a fragmentary cross-sectional view showing a wiper and a brush in the horizontal-rail-mounting cleaning apparatus main unit.

Referring now to FIGS. 13 and 14, a description will next be made of the modifications of the horizontal-rail-mounting automated cleaning apparatus A according to the first embodiment of the present invention. The automated cleaning apparatus is generally used for the windowpanes G located at the same level. The modified cleaning apparatus can be used for window-panes G,G' located at two levels which are different from each other. A cleaning apparatus main unit A' itself is mounted on the upper and lower rails 1a,1b so that it can travel by itself. As the area of the windowpanes G,G' to be cleaned has become wider, plural cleaning devices which are each composed of the wiper 71, the brush 72 and the like are accommodated in correspondence to the thus-increased area of windowpanes G,G'. To be sufficient for these plural cleaning devices, an additional gear motor Mp and spray nozzles 46 are arranged so that the washing water W can be drawn from the horizontal drainage 3 arranged in the lower rail 1b and can then be sprayed against the windowpane G' too. Further, the cleaning device comprising the brush 72 and the like and maintained in contact with the surface of the windowpane G' is integrally connected with the brush 72, which is maintained in contact With the surface of the upper windowpane G and movable up and down, by way of an interlocking rod 105 so that they can be associated in operation. The above modification makes it possible to perform, at once, cleaning work for the windowpanes G,G' located at the two levels on the exterior wall of the building, so that the cleaning work itself can be performed still more promptly. Further, the windowpanes G' can be a surface finished with tiles or the like on a precast concrete or general concrete wall. In this case, it is possible to clean the windowpanes G and the wall surface at the same time as is illustrated in FIG. 2.

Figure 15:
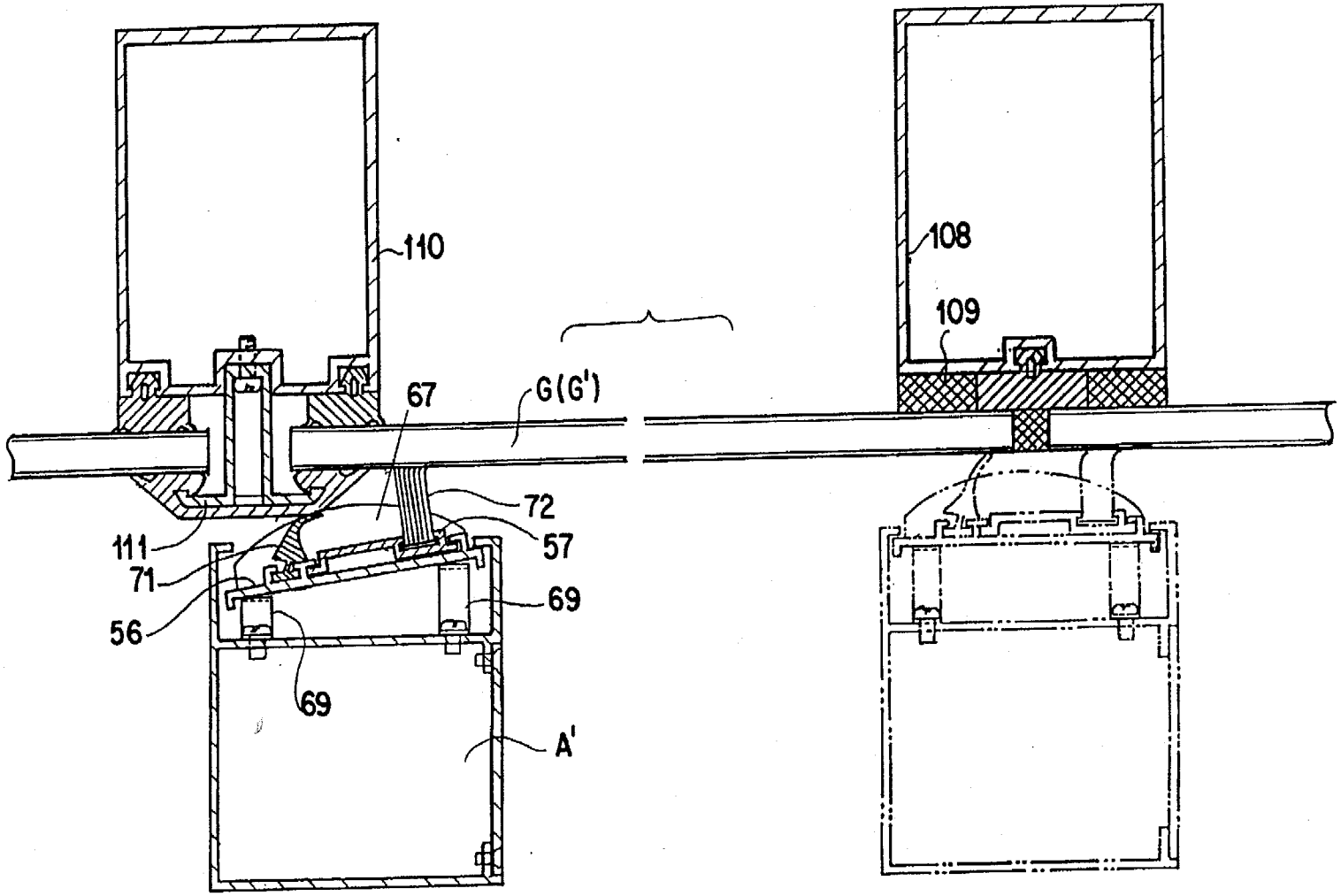
FIG. 15 is a horizontal cross-sectional view illustrating a modification of a wiper- and brush-mounting portions in a vertical-rail-mounting cleaning apparatus main unit.

The modification depicted in FIG. 15 is directed to the cleaning devices which are each composed of the wiper 71, the brush 72 and the like accommodated in the corresponding cleaning apparatus main unit A'. Although the cleaning apparatus main units A' are mounted on mullions 108,110, respectively, in the drawing, a similar modification is feasible when the cleaning apparatus main units are mounted on the upper and lower rails 1a,1b. In each cleaning apparatus main unit A', retractable leaf springs 69 are arranged behind the wiper and brush holders 56,57, respectively, which hold the wiper 71 and the brush 72 of the cleaning device. Even if a mullion cover 111—which is located between the windowpanes G,G', holds proximal side edges of the windowpanes G,G' and is integral with the mullion 110—extends out and forms steps, the wiper 71 and brush 72 can ride over the steps without being caught by the steps because the leaf springs 69 are allowed to expand or retract in conformity with the shapes of the steps of the outwardly-extending mullion cover 111. The wiper 71 and the brush 72 are therefore always maintained in contact under constant force with the surfaces of the windowpanes G,G' so that the windowpanes G,G' can be successfully cleaned.

Figure 16:
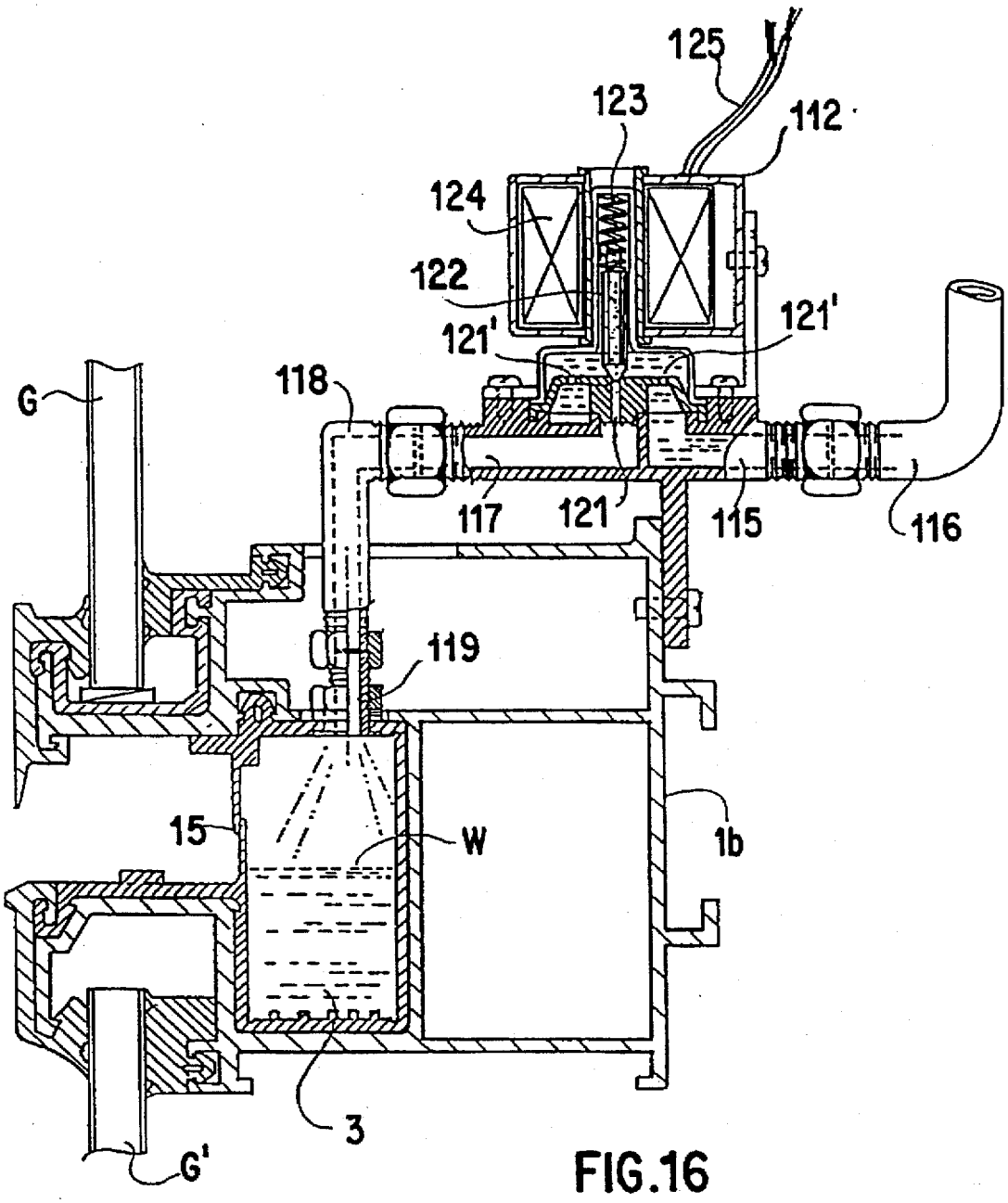
FIG. 16 is a fragmentary vertical side cross-sectional view depicting a water supply structure for a horizontal drainage.
Figure 19:
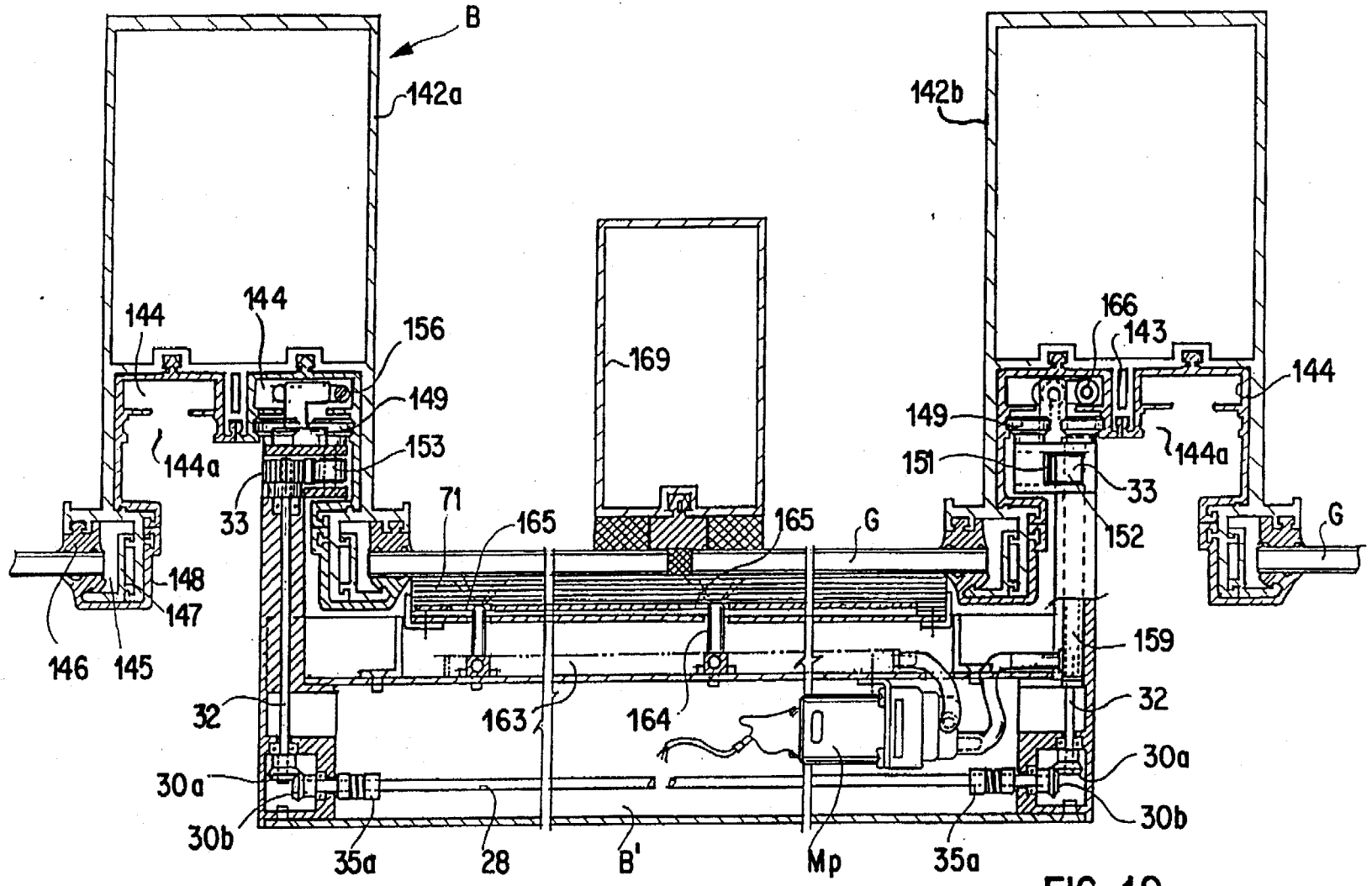
FIG. 19 is a horizontal cross-sectional view of a vertical-rail-mounting cleaning apparatus main unit, vertical rails and a mullion, said vertical rails and mullion being associated with said vertical-rail-mounting cleaning apparatus main unit, said cleaning apparatus main unit and said vertical rails and mullion all pertaining to a second embodiment of the present invention.
Figure 20:
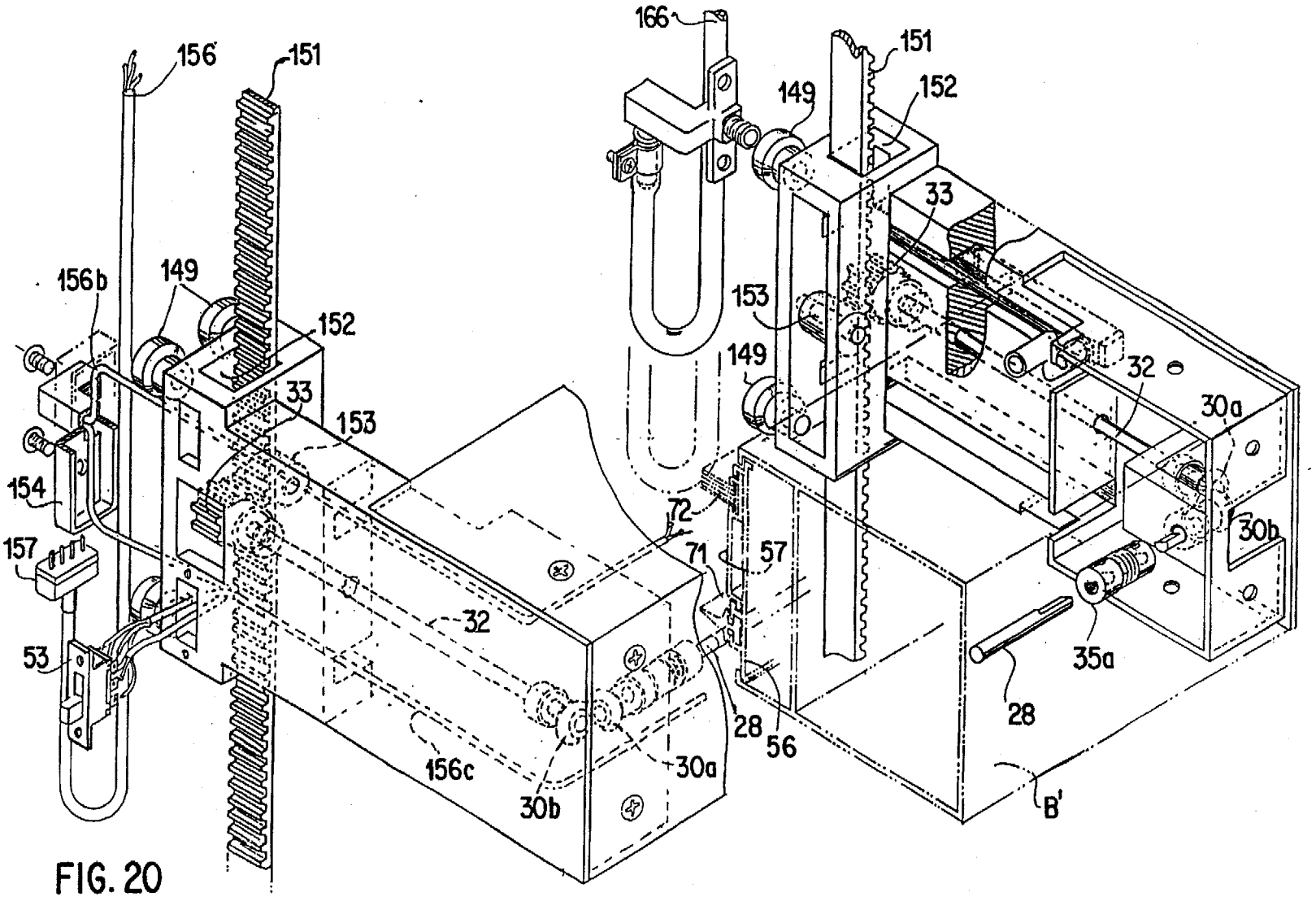
FIG. 20 is a fragmentary perspective view of the vertical-rail-mounting cleaning apparatus main unit of FIG. 19.

Further, FIGS. 16, 17 and 18 illustrate the structures for supplying or draining the above-described washing water W to or from the horizontal drainage 3 in the first embodiment of the present invention. The horizontal drainage 3 is arranged in the lower rail 1b and is adapted to store the washing water W to be sprayed against windowpanes and the like upon performing cleaning work. FIG. 16 shows the structure for supplying the washing water W to the horizontal drainage 3 which is the hollow member arranged inside the lower rail 1b. Described specifically, washing water to be stored in the lower rail 1b is received through a water intake port 115 which is connected to a water guide pipe 116 at a desired location in the lower rail 1b. Through small holes 121', the washing water is guided into a chamber formed inside an electromagnetic water supply unit 112. Through lead wires 125, an electric current is fed to an electromagnetic coil 124 of the electromagnetic water supply unit 112. As a consequence, the electromagnetic coil 124 produces a magnetic field. A core 122 is arranged together with a coil spring 123 within the electromagnetic coil 124 and under the expanding force of the coil spring 123, normally closes by its free end portion a small hole 121 communicated to a water supply port 117. The core 122 is attracted upward by the magnetic field so that the small hole 121 is opened. As a result, the washing water W which has been guided to the upper chamber through the water intake port 115 is promptly supplied by its own hydraulic pressure into the horizontal drainage 3 through the small hole 121, the water supply port 117, an L-shaped water guide pipe 118 and a joint pipe 119. Referring next to FIGS. 17 and 18, the drain structure for the washing water W stored in the horizontal drainage 3 arranged in the lower rail 1*b* will be described. By a valve 134 forming an electromagnetic drain unit 137 at a desired location in the lower rail 1*b*, a drain port 135 through which a drain tank 132 is communicated to a drain pipe 139 is normally closed. Via a shaft 134*a*, this valve 134 is arranged integrally with a core 137*a* which is inserted in a solenoid 137*b* and is provided with a coil spring 138 externally mounted thereon. The valve 134 is normally biased upwardly via the shaft 134*a* owing to the expanding force of the coil spring 138 so that the drain port 135 of the drain tank 132 is kept open. Water such as rain water, which may flow into the horizontal drainage 3 in the lower rail 1*b*, is therefore drained to the outside through the drain pipe 139. During cleaning work, however, an electric current is fed to the solenoid 137*b* through lead wires 137*c*. The core 137*a* inserted in the solenoid 137*b* is then magnetically attracted so that the core 137*a* moves downward. The valve 134 which is integral with the core 137*a* via the shaft 134*a* is therefore closely fitted in the drain port 135 of the drain tank 132. The drain port 135 is therefore surely closed, thereby making it possible to store the washing water W in the horizontal drainage 3.

Above the drain tank 132, a water tank 126*a* is arranged integrally in communication with the drain tank 132. Inside the water tank 126*a*, a magnetic float 128 is externally loose-fitted and held on a cylinder 129 in which lead wires 127 with closable armatures 130*a*,130*b* attached to free ends thereof are enclosed. At the beginning of water-pouring, no washing water exists in the water tank 126*a* so that the magnetic float 128 lies in the bottom of the water tank 126*a*. The armatures 130*a*,130*b* inside the cylinder 129 on which the magnetic float 128 is externally loose-fitted are therefore maintained in contact with each other, thereby permitting feeding of an electric current therethrough. By feeding an electric current through the lead wires 127 which are connected in series to the lead wires for the electromagnetic water supply unit 112, water is poured into the horizontal drainage 3 arranged in the lower rail 1*b*. As the pouring of water into the horizontal drainage 3 arranged in the lower rail 1*b* proceeds, the level of the cleaning water W arises in the water tank 126*a* communicated with the drain tank 132. Keeping step with the rise of the level of the washing water W, the magnetic float 128 also arises in the water tank 126*a*. When the magnetic float 128 arises to a predetermined height, the armature 130*a*,130*b* in the cylinder 129 on which the magnetic float 128 is externally loose-fitted are moved out of the range of magnetic force of the magnetic float 128 and are hence opened. It is therefore no longer possible to feed an electric current through the lead wires 127 which are connected in series to the lead wires 125 for the electromagnetic water supply unit 112. Washing water therefore no longer flows into the horizontal drainage 3. After completion of the washing work, the feeding of the electric current to the solenoid 137*b* through the lead wires 137*c* is stopped. The core 137*a* which has been biased downwardly by the energization of the solenoid 137*b* becomes no longer attracted by the solenoid 137*b*. By the expanding force of the coil spring 138, the core 137*a* is caused to move upward. The valve 134 which is integral with the core 17*a* via the shaft 134*a* is also caused to move upward, whereby the drain port 135 of the drain tank 132 is opened. The washing water W stored in the horizontal drainage 3 is therefore drained into the drain pipe 139 through the drain port 135 of the drain tank 132.

With reference to FIGS. 19 through 23, the automated cleaning apparatus B of the vertical-rail-mounting type according to the second embodiment of the present invention for an exterior wall of a building will be described. This automated cleaning apparatus B comprises a vertical frame which is constructed of a left and right vertical rails 142*a*, 142*b* arranged on left and right sides of a windowpane to hold it in place in the exterior wall of the building and can be mullions and/or vertical sash rails, and a cleaning apparatus main unit B' mounted on the vertical frame 142*a*, 142*b* so that the cleaning apparatus main unit B' can vertically travel by itself while being guided (see FIG. 20).

In the vertical frame 142 formed of the vertical rails 142*a*,142*b* arranged in a parallel side-by-side relationship to hold a windowpane G in place in the exterior wall of the building, the vertical rails 142*a*,142*b* which make up the vertical frame and define a closed space therebetween are equipped with vertical drainages 144, respectively. The vertical drainages 144 are hollow members, which are made of an electrically-insulating or water-tight material, for example, an elastic material such as a synthetic rubber, for example, silicone rubber and have open edges 144*a* through which the vertical drainages 144 communicate to the outside. The vertical drainages 144 of the respective vertical rails 142*a*,142*b* are internally provided with wheels 149 which are driven by a drive mechanism accommodated within the cleaning apparatus main unit B'. Further, pulley gears 33—which are mounted on drive shafts 28,32 similarly driven by the drive mechanism accommodated within the cleaning apparatus main unit B' —are maintained in meshing engagement with rack belts 151 arranged in guide channels 152, respectively. Rotation of the pulley gears 33 causes the cleaning apparatus main unit B' to vertical travel by itself while being guided by the vertical drainages 144. At the same time, washing water W from a water supply hose 166 which extends through the vertical drainage 144 arranged inside the right-hand vertical rail 142*b* is sprayed against the windowpane G—with which a cleaning device mounted in the cleaning apparatus main unit B', such as a wiper 71 and a horizontally-movable brush 72, is maintained in contact—from spraying holes 165 in a wiper hole 56 and a brush holder 57 by a gear pump 65 driven by a gear motor Mp in the cleaning apparatus main unit B40 via a water supply hose 163 and nozzles 164.

Figure 21:
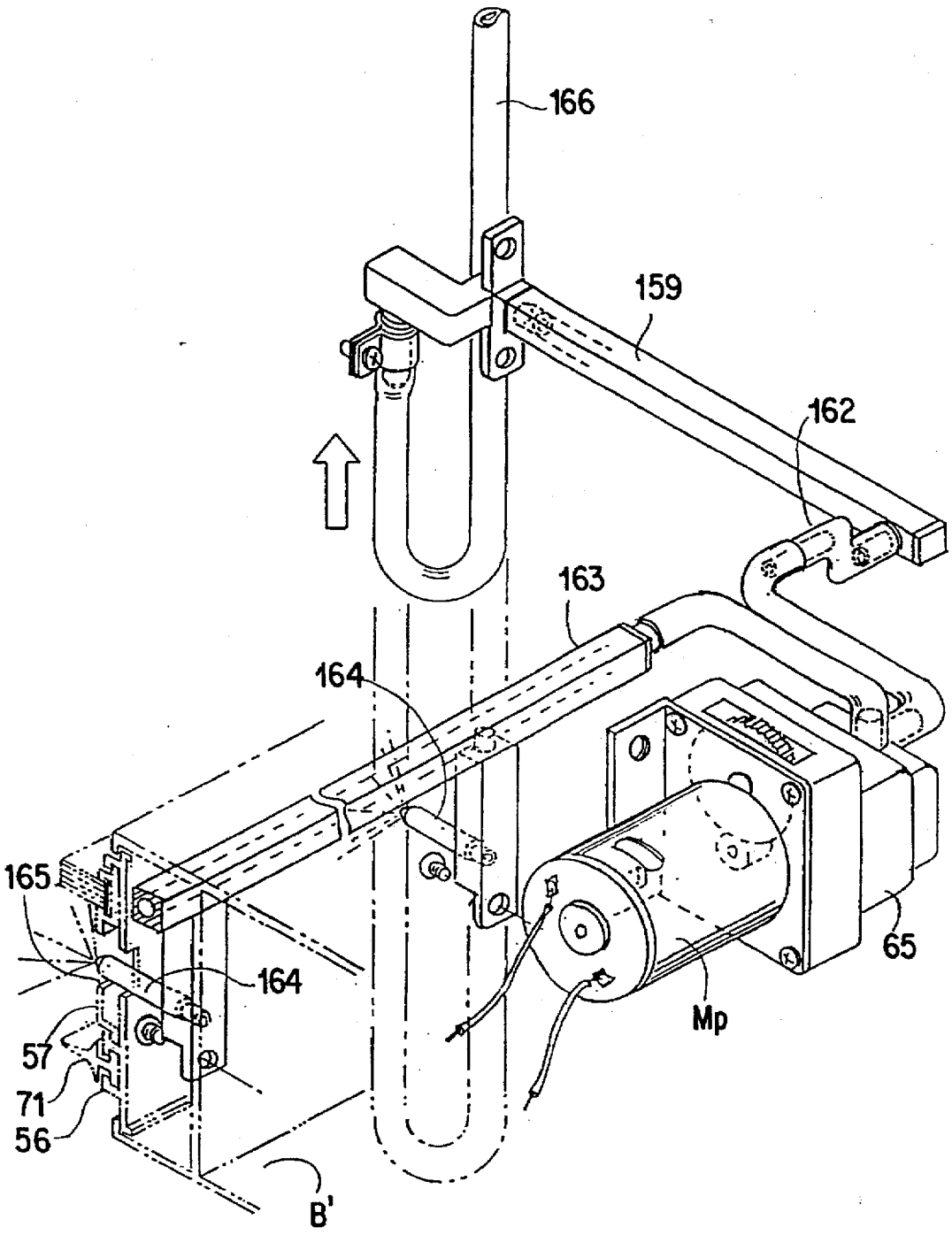
FIG. 21 is a fragmentary perspective view of a wiper, a brush and a water supply unit illustrated in FIG. 19.
Figure 22:
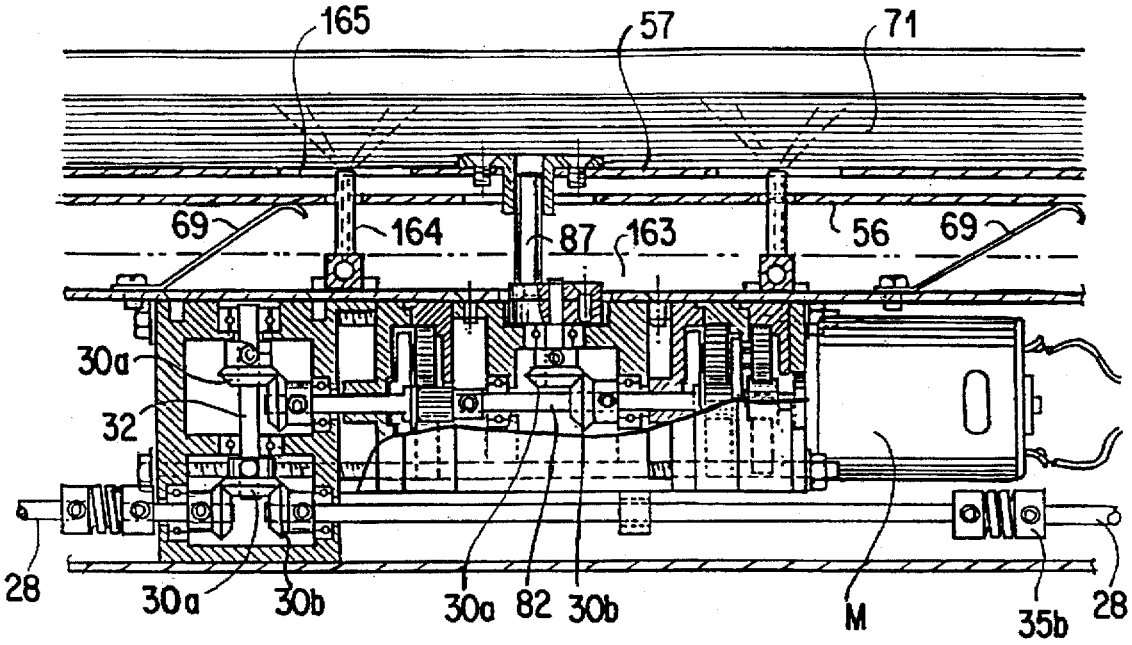
FIG. 22 is a horizontal cross-sectional view of a self-travelling unit in the vertical-rail-mounting cleaning apparatus main unit according to the second embodiment.
Figure 23:
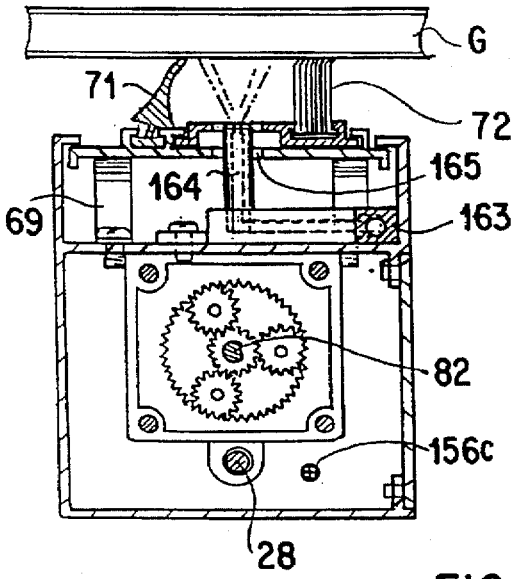
FIG. 23 is a fragmentary plan view of the wiper and brush in the vertical-rail-mounting cleaning apparatus main unit according to the second embodiment.

The washing water W supplied to the cleaning apparatus main unit B', which forms the vertical-rail-mounting automated cleaning apparatus according to the second embodiment of the present invention B, is supplied to a water supply hose 163 through the water supply hose 166, which is inserted in the right-hand vertical rail 142*b* so that the water supply hose 166 is paid out or taken up in accordance with upward or downward movement of the cleaning apparatus main unit B', a water guide pipe 159 integrally connected to the water supply hose 166 and a sleeve pipe 162, and is sprayed against the surface of the windowpane G from the plural nozzles 164, which are arranged in communication with the water supply hose 163, through the spraying holes 165 formed in the wiper holder 56 and the brush holder 57, as illustrated in FIG. 21. Regarding the cleaning device composed of the wipers 71 and the brushes 72, rotating power of a drive shaft 82 driven by a gear motor M accommodated in the cleaning apparatus main unit B' is transmitted to the brushes 72 via plural gears mounted on the drive shaft 82 and associated gears mounted on respective brush holders in mesh with the corresponding gears as illustrated in FIGS. 22 and 23. Cleaning of the windowpane G by the cleaning device is performed as will be described next. While spraying the washing water W under high pressure from the individual nozzles 164 against the windowpane G, the brushes 72 are moved leftward and rightward to rub off dirt on the surface of the windowpane G. The cleaning water W is then wiped off along with the dirt by the wipers 71.

Since the second embodiment of the present invention is provided with the above-described features, cleaning crew feed electric power to the gear motor M through conductors received in the hollow member in one of the vertical rails (including the mullion), that is, a power supply cord 156 and a lead wire 156*c* upon cleaning the windowpane G in the exterior wall of the building. As a result, the gear motor M is driven and at the same time. Drive power of this gear motor M is transmitted as rotating power, through the drive shaft 82 arranged coaxially with the gear motor M and then through drive shafts 32,28,28, to pulley gears 33 maintained in meshing engagement with left and right rack belts 151 disposed in the vertical drainages 144 arranged in the left and right vertical rails 142*a*,142*b*. The cleaning apparatus main unit B' can therefore travel up and down by itself.

Concurrently with the actuation of the gear motor M, the gear motor Mp accommodated within the cleaning apparatus main unit B' is also actuated. The washing water is introduced into the cleaning apparatus main unit B' through the water supply hose 166, water guide pipe 159, sleeve pipe 162 and the water supply hose 163 and is then sprayed against the surface of the windowpane G from the plural nozzles 164 through the spraying holes 165 formed in the wiper holder 56 and the brush holders 57. At the same time, by the actuation of the gear motor M, the brushes 72 are moved leftward and rightward to rub off dirt on the surface of the windowpane G while wiping off the cleaning water together with the dirt by the wiper 71. It is therefore possible to promptly surely perform cleaning of the windowpane G.

Figure 1:
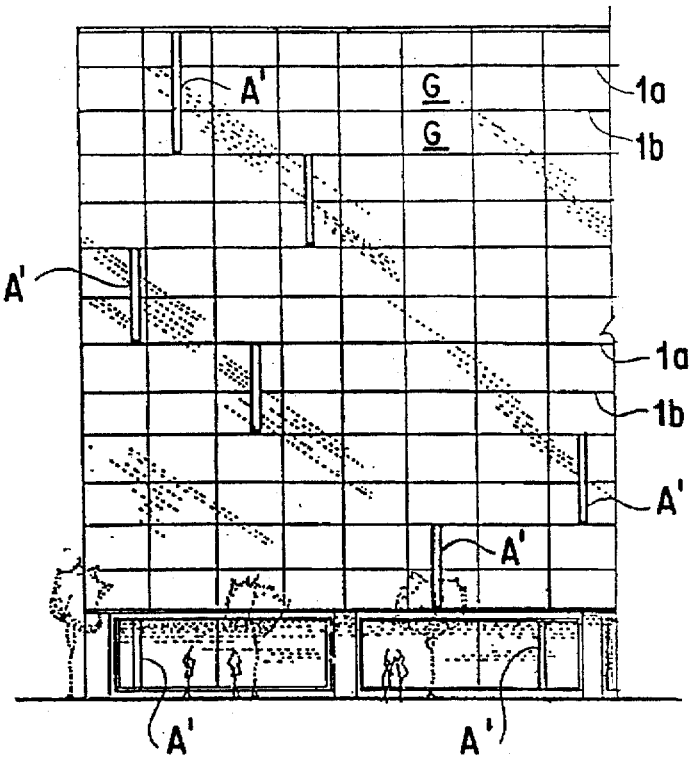
FIG. 1 is a front elevation of an exterior wall of a building, on which a plurality of horizontal-rail-mounting cleaning apparatus main units according to a first embodiment of the present invention have been mounted for horizontal movement.
Figure 3:
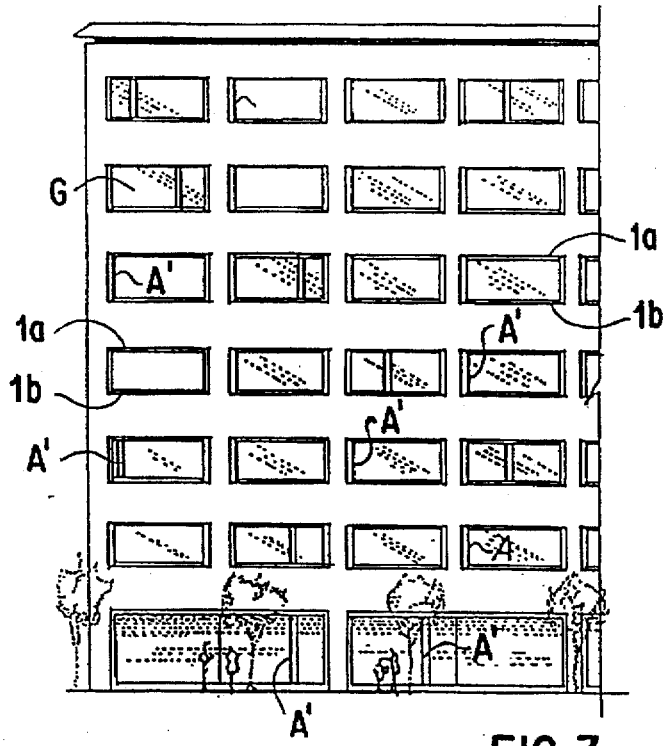
FIG. 3 is similar to FIG. 1, but the horizontal-rail-mounting cleaning apparatus main units have been mounted on an exterior wall different from those of FIGS. 1 and 2.
Figure 4:
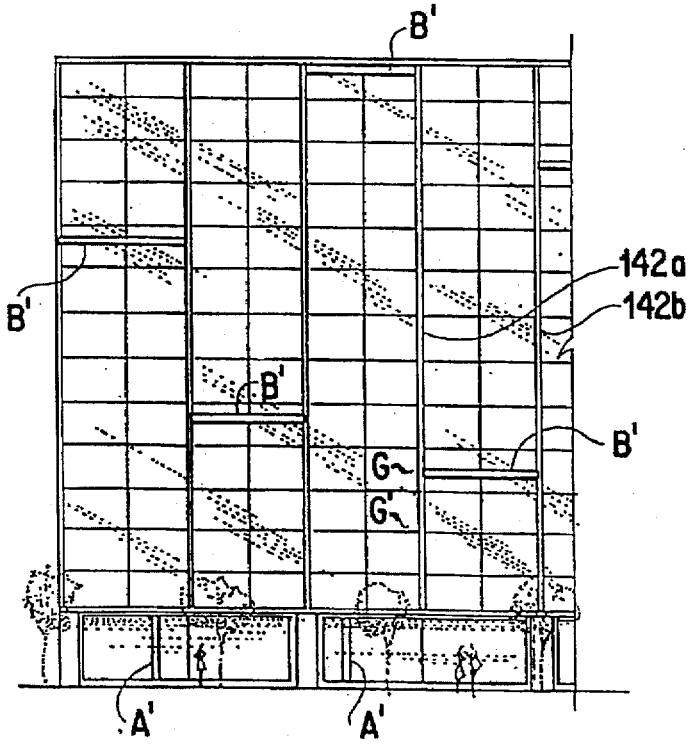
FIG. 4 is a front elevation of an exterior wall of a building, on which a plurality of vertical-rail-mounting cleaning apparatus main units according to a second embodiment of the present invention have been mounted for vertical movement.

FIGS. 1, 2 and 3 are front elevations showing plural cleaning apparatuses of the same type as the cleaning apparatus according to the first embodiment of the present invention as mounted on exterior walls of buildings, respectively. The exterior walls are different in structure and have horizontal rails. On the other hand, FIG. 4 is a front elevation illustrating plural cleaning apparatuses of the same type as the cleaning apparatus according to the second embodiment of the present invention as mounted on an exterior wall of a building. The exterior wall is provided with vertical rails.

What is claimed is:

1. An automated cleaning method for cleaning an exterior wall of a building, comprising:

providing elongated hollow members extending continuously in a horizontal direction within sash rails of said exterior wall, a fluid-tight of said hollow members forming a drainage and an electrically-insulated of said hollow members containing an electrical conductor;

arranging a cleaning apparatus main unit in a horizontally movable manner along said sash rails, said cleaning apparatus main unit being electrically connected to said electrical conductor and being in fluid communication with a washing fluid contained in said drainage;

moving said cleaning apparatus main unit in a horizontal direction along said sash rails while drawing washing fluid from said drainage through said cleaning apparatus main unit and spraying said washing fluid onto said exterior wall; and recovering said washing fluid sprayed onto the exterior wall in said drainage.

2. An automated cleaning method according to claim 1, further comprising brushing the exterior wall with said cleaning apparatus main unit while said cleaning apparatus main unit is being moved along said sash rails.

3. An automated cleaning method according to claim 2, further comprising wiping the washing fluid off of the exterior wall with said cleaning apparatus main unit while said cleaning apparatus main unit is being moved along said sash rails.

4. An automated cleaning method according to claim 1, further comprising wiping the washing fluid off of the exterior wall with said cleaning apparatus main unit while said cleaning apparatus main unit is being moved along said sash rails.

5. An automated cleaning method for cleaning an exterior wall of a building, comprising:

providing upper and lower elongated hollow members in respective upper and lower sash rails of said exterior wall, said hollow members extending continuously in a horizontal direction, said upper hollow member containing an electrical conductor and said lower hollow member forming a drainage;

supporting a cleaning apparatus main unit in a horizontally movable manner on said sash rails, said cleaning apparatus main unit including an intake pipe in fluid communication with a washing fluid contained in said drainage, a nozzle directed toward said exterior wall, and a water supply pump powered via said electrical conductor to pump said washing fluid from said drainage to said nozzle;

moving said cleaning apparatus main unit in a horizontal direction along said sash rails while operating said water supply pump to spray said washing fluid from said nozzle onto said exterior wall; and recovering said washing fluid sprayed onto the exterior wall in said drainage.

6. An automated cleaning method according to claim 5, further comprising brushing the exterior wall with said cleaning apparatus main unit while said cleaning apparatus main unit is being moved along said sash rails.

7. An automated cleaning method according to claim 6, further comprising wiping the washing fluid off of the exterior wall with said cleaning apparatus main unit while said cleaning apparatus main unit is being moved along said sash rails.

8. An automated cleaning method according to claim 5, further comprising wiping the washing fluid off of the exterior wall with said cleaning apparatus main unit while said cleaning apparatus main unit is being moved along said sash rails.

9. An automated cleaning method for cleaning an exterior wall of a building having elongated hollow members extending continuously in a horizontal direction within sash rails of said exterior wall, a fluid-tight of said hollow members forming a drainage and an electrically-insulated of said hollow members containing an electrical conductor, said method comprising:

supplying a washing fluid to said drainage;

arranging a cleaning apparatus main unit in a horizontally movable manner along said sash rails, said cleaning apparatus main unit being electrically connected to said electrical conductor and being in fluid communication with said washing fluid in said drainage;

moving said cleaning apparatus main unit in a horizontal direction along said sash rails while drawing washing fluid from said drainage through said cleaning apparatus main unit and spraying said washing fluid onto said exterior wall; and recovering said washing fluid sprayed onto the exterior wall in said drainage.

10. An automated cleaning method according to claim 9, further comprising brushing the exterior wall with said cleaning apparatus main unit while said cleaning apparatus main unit is being moved along said sash rails.

11. An automated cleaning method according to claim 10, further comprising wiping the washing fluid off of the exterior wall with said cleaning apparatus main unit while said cleaning apparatus main unit is being moved along said sash rails.

12. An automated cleaning method according to claim 9, further comprising wiping the washing fluid off of the exterior wall with said cleaning apparatus main unit while said cleaning apparatus main unit is being moved along said sash rails.

13. An automated cleaning method for cleaning an exterior wall of a building having upper and lower elongated hollow members in respective upper and lower sash rails of said exterior wall, said hollow members extending continuously in a horizontal direction, said upper hollow member containing an electrical conductor and said lower hollow member forming a drainage, said method comprising:

supplying a washing fluid to said drainage;

supporting a cleaning apparatus main unit in a horizontally movable manner on said sash rails, said cleaning apparatus main unit including an intake pipe in fluid communication with said washing fluid in said drainage, a nozzle directed toward said exterior wall, and a fluid supply pump powered via said electrical conductor to pump said washing fluid from said drainage to said nozzle;

moving said cleaning apparatus main unit in a horizontal direction along said sash rails while operating said water supply pump to spray said washing fluid from said nozzle onto said exterior wall; and recovering said washing fluid sprayed onto the exterior wall in said drainage.

14. An automated cleaning method according to claim 13, further comprising brushing the exterior wall with said cleaning apparatus main unit while said cleaning apparatus main unit is being moved along said sash rails.

15. An automated cleaning method according to claim 14, further comprising wiping the washing fluid off of the exterior wall with said cleaning apparatus main unit while said cleaning apparatus main unit is being moved along said sash rails.

16. An automated method according to claim 13, further comprising wiping the washing fluid off of the exterior wall with said cleaning apparatus main unit while said cleaning apparatus main unit is being moved along said sash rails.

* * * * *